United States Patent [19]

Sperry et al.

[11] 4,244,684

[45] Jan. 13, 1981

[54] METHOD FOR CONTROLLING CORROSION IN THERMAL VAPOR INJECTION GASES

[75] Inventors: John S. Sperry; Richard W. Krajicek, both of Houston, Tex.

[73] Assignee: Carmel Energy, Inc., Houston, Tex.

[21] Appl. No.: 47,726

[22] Filed: Jun. 12, 1979

[51] Int. Cl.[3] ..... F23L 7/00; F23D 11/44

[52] U.S. Cl. ..... 431/4; 60/39.05

[58] Field of Search ..... 60/39.05; 431/3.4

[56] References Cited

U.S. PATENT DOCUMENTS

| | | | |
|---|---|---|---|
| 729,989 | 6/1903 | Zaruba | 431/4 |
| 1,817,470 | 8/1931 | Adams | 431/4 |
| 3,276,205 | 10/1966 | Reisman . | |
| 3,748,080 | 7/1973 | Dunn | 431/4 |
| 3,901,644 | 8/1975 | Aramas | 431/4 |
| 4,115,515 | 9/1978 | Tennen . | |
| 4,118,925 | 10/1978 | Sperry . | |
| 4,119,703 | 10/1978 | Nishida . | |

*Primary Examiner*—George E. Lowrance

*Attorney, Agent, or Firm*—Pravel, Gambrell, Hewitt, Kirk, Kimball & Dodge

[57] ABSTRACT

An improvement in the method for producing high pressure thermal vapor streams from combustion gases for injection into subterranean oil producing formations to stimulate the production of viscous minerals is described. The improvement involves controlling corrosion in such thermal vapor gases by injecting water near the flame in the combustion zone and injecting ammonia into a vapor producing vessel to contact the combustion gases exiting the combustion chamber.

7 Claims, 2 Drawing Figures

AIR COMP.
A
FUEL SUPPLY
F
$H_2O$
WATER SUPPLY
W
AMMONIA
WATER
WATER
FUEL

METHOD FOR CONTROLLING CORROSION IN THERMAL VAPOR INJECTION GASES

The government of the United States of America has rights in this invention pursuant to Contract No. ET-78-C-03-2046 as rendered by the U.S. Energy Research and Development Administration (now Department of Energy).

TECHNICAL FIELD OF THE INVENTION

The present invention relates to a method of controlling corrosion in hot gases being injected into an underground formation to warm the formation to enhance mineral production, particularly viscous petroleum. More particularly, the invention concerns the injection of water into a combustion chamber which produces the hot gases and the later addition of ammonia to the hot gases. This method has special significance when employed with a method of producing a high pressure, thermal vapor stream of water vapor and combustion gases for injection into a subterranean formation to stimulate the production of viscous minerals, especially hydrocarbons.

PRIOR ART

The prior art is replete with different methods to stimulate the production of viscous minerals by underground heating or underground injection of heat through the use of gas and steam streams. A major problem with secondary recovery methods is that of the corrosion resulting from nitrogen oxides and sulfur oxides.

The invention is particularly effective when practiced in conjunction with the method and apparatus described in U.S. Pat. No. 4,118,925 for producing a high pressure, thermal vapor stream comprising steam and combustion gases for injection into a subterranean formation for the recovery of viscous minerals. The thermal vapor injection gases must have sufficient superheat as described in said patent to avoid condensation before contacting the formation. During the practice of the method of U.S. Pat. No. 4,118,925 corrosion was discovered to be a serious problem causing interruption in injection and costly repairs particularly during the period when piping down stream from the thermal vapor producing equipment was being heated. Despite the unique design of the mineral recovery apparatus and method to facilitate complete combustion, large amounts of nitrogen oxides and sulfur oxides were being produced when sulfur containing fuel was being burned.

Two recent methods, U.S. Pat. Nos. 4,115,515 and 4,119,703, describe the use of ammonia to reduce NOx emissions to the atmosphere from combustion gases which are vented directly. But the necessity of a catalyst and their inability to economically reduce nitrogen oxides and sulfur oxides to the very low levels needed for corrosion control make them generally inapplicable to the problem at hand. While it is known that NOx is formed by the fixation of nitrogen in air at elevated temperature and pressure the reduction of temperature alone does little or nothing to combat the formation of sulfur oxides.

SUMMARY OF THE INVENTION

The practice of the present invention produces a high pressure, thermal vapor stream comprising steam and combustion gases for injection into a subterranean formation, for the recovery of viscous minerals therefrom, almost totally free of corrosion-causing oxides of nitrogen and sulfur. The practice of this invention is particularly important during the period wherein the equipment and downhole tubing is being warmed up because some condensation of water usually occurs with attendant corrosion, even when the thermal vapor produced is initially superheated. The method of this invention involves injecting water through a specifically positioned injector means adjacent to the fuel injector nozzle into the combustion zone of the combusion chamber. It was found that the water injected lowers the interior temperature of the combustion chamber sufficient to decrease the fixation of nitrogen with oxygen without impairing the overall quality of the thermal vapor gases injected down the well bore.

The combusion gases pass from the combusion chamber into a vapor producing vessel. Where ammonia is injected to further neutralize the acidic oxides of nitrogen and sulfur in the high pressure thermal vapor stream, which is the output of the vapor producing vessel. This thermal vapor stream of water vapor and combustion gases is then pumped underground into a subterranean mineral formation, particularly as described in U.S. Pat. Nos. 3,948,323 and 3,993,135.

BRIEF DESCRIPTION OF THE DRAWINGS

The instant invention will be better understood by reference to the drawing which illustrates a specific preferred embodiment of equipment useful in the practice of this invention.

DETAILED DESCRIPTION

Figures 1, 2:
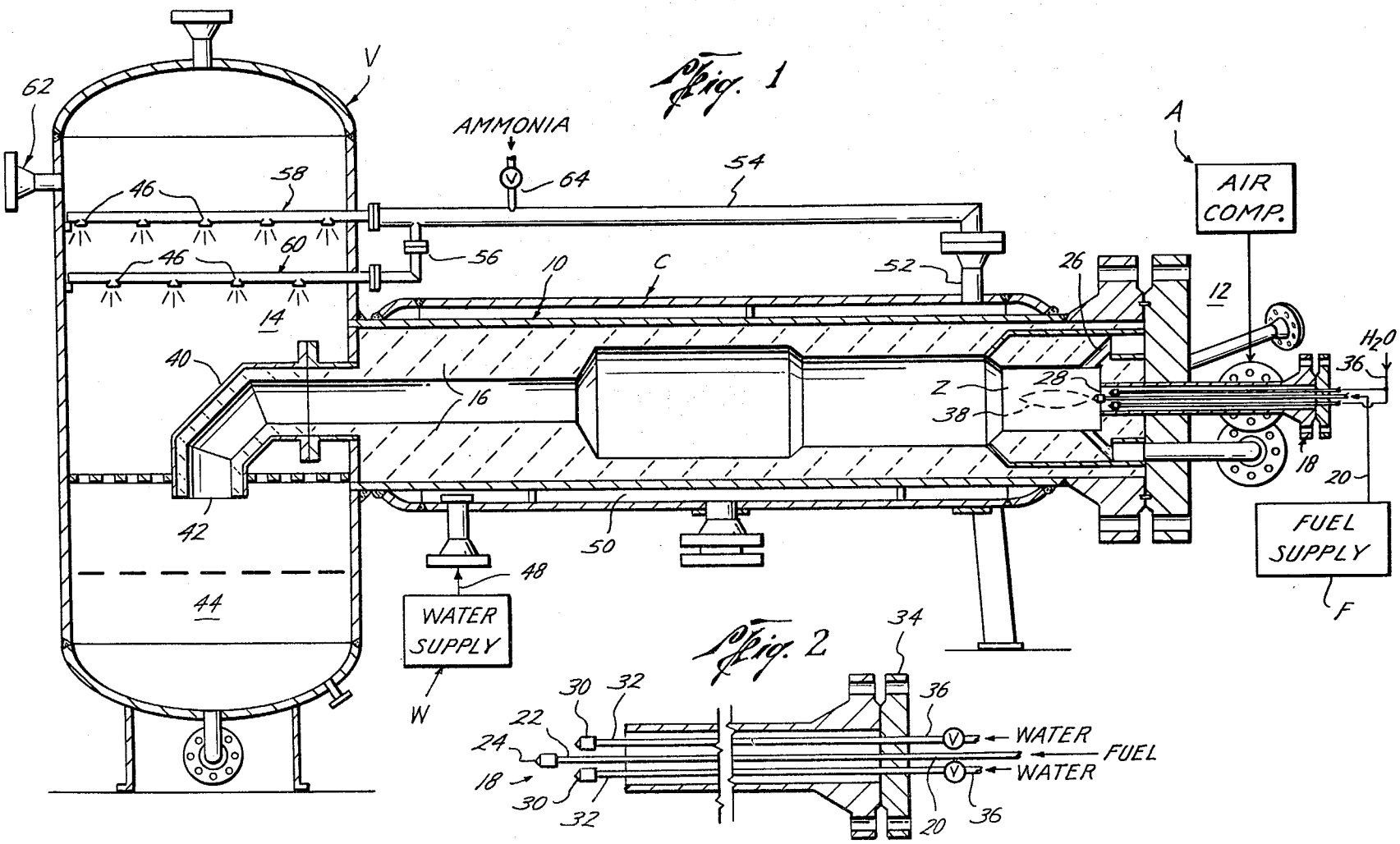
FIG. 1 is a cross-sectional view of the combustion chambers invention and the vapor producing vessel illustrating the details thereof used in the practice of this invention.
FIG. 2 shows the detail of the preferred embodiment of the water injection means into the combustion zone.

Heat is applied to mineral formations, particularly formations containing high viscosity petroleum crudes, to lower the viscosity of the minerals and promote their movement toward a producing well. This is done through the use of a high pressure, thermal vapor stream of water vapor and combustion gases which is injected into the mineral formations. It is preferable that the gases be in the superheat range to improve the recovery of such crudes. The recovery of certain viscous minerals, such as hydrocarbons, sulfur, mercury, and minerals and ores which are melted at low temperatures can be increased substantially.

The apparatus used in the practice of the method of this invention consists of a high pressure combustion chamber C which is connected to a fuel supply means F, a pressure air supply means A and a water supply W preferably like the one described in U.S. Pat. 4,118,925, the disclosure of which is incorporated herein by reference. The combustion gases which are produced in the combustion chamber C are channeled into a vapor producing vessel V from which the high pressure, thermal vapor stream is pumped down tubing in the well-bore to the producing formation in a manner such as is described in U.S. Pat. Nos. 3,948,323 and 3,993,135, for example.

The air supply means A includes at least one high capacity, air compressor capable of supplying pressurized air at a volume of up to about 56,600 cubic meters per day under a pressure within the range of from about 16,300 to about 52,500 mm.Hg. The high pressure air stream is usually supplied to the combustion chamber C as described in the above-mentioned U.S. Pat. No. 4,118,925. The air stream injection means are provided to facilitate substantially complete combustion of the hydrocarbon fuel. This complete combustion produces a continuous flowing stream of hot combustion gases substantially free of oxidizing components and solid carbonaceous particles. As used herein, the term "combustion gases" is defined to include the gases from combustion of the hydrocarbon fuel, whether natural gas, a refined fuel or a leasehold crude oil, i.e., carbon dioxide, carbon monoxide, water, oxides of nitrogen and sulfur, and inert gases entering the combustion chamber with the air used for combustion.

The water supply means W includes suitable pressure pumps or the like capable of supplying a continuous stream of water from a suitable storage or supply area to the primary combustion chamber, the outer water jacket around the combustion zone and the steam generating vessel V.

The high pressure combustion chamber C preferably includes a substantially cylindrical, pressure casing 10 having an inlet end 12 and an exhaust outlet 14 provided at its opposing end. The exhaust outlet 14 has an annular flange 16 for interconnection with a similar flange of the preferred steam generating vessel V for passing the hot combustion gases produced in the combustion chamber C to the steam producing vessel V. The pressure casing 10 and the exhaust outlet 14 are lined with a continuous inner layer of refactory material 16 which forms the combustion zones, preferably four such zones. The continuous inner layer refactory material 16 has portions of varying cross-sectional thicknesses to form sections of varying inner diameters to form different zones of combustion as shown in the aforementioned U.S. Pat. No. 4,118,925.

This preferred configuration of the combustion chamber C provides considerable turbulence and intimate mixing to insure complete combustion.

The substantially complete control of oxides of nitrogen and sulfur afforded by this invention can be realized even when burning hydrocarbon fuels having up to five percent sulfur by weight and two percent nitrogen by weight to provide the combustion gases. A stoichiometric mixture of fuel and air is preferred so that no excess oxygen in the air is available, but in the practice of this invention up to about five percent molar excess of oxygen can be tolerated, preferably about three percent molar excess of air. The rapid radial expansion between the different combustion zones causes turbulence which thoroughly mixes the fuel and air for more complete combustion. The substantially complete mixing provides near complete combustion of the fuel so that the combustion gases are substantially free of non-oxidizing gases. A deficiency of air must be avoided in order to avoid formation of coke in the combustion zone.

Water is injected, as hereinafter described, into the near vicinity of the combustion flames in amounts of from about 0.2 to about 4 liters of water per liter of fuel burned. The fuel rate can vary from about 19 liters/hour to about 340 liters/hour with from about 190 to about 285 liters/hour being preferred. Of course, the amount of water injected depends upon the analysis of the fuel and may vary considerably according to need.

The combustion chamber C is provided with an injection assembly 18, an enlargement of which is shown in FIG. 2, for supplying the hydrocarbon fuel from the fuel supply F through line 20, tubing 22 and nozzle 24 into the combustion zone Z. The fuel injection tube 22 extends longitudinally into the combustion zone Z and has one or more nozzles 24 of known construction for injecting the fuel into the combustion zone Z. These nozzles 24 atomize the fuel into a fine spray mist to provide thorough mixing of the fuel with air entering through openings 26 and 28 to facilitate essentially complete combustion thereof. Similar nozzles 30 attached to tubing 32 are used to inject water in an atomized spray into the combustion zone Z. The combustion zone Z, as described in U.S. Pat. No. 4,118,925, incorporated herein by reference, has several zones with the initial combustion occurring in the primary combustion zone near the fuel injection point.

As is more clearly seen in FIG. 2, the water tubes 32 are connected through flange 34 to water feed tubes 36 to a source of water (not shown). Valves are placed on the tubes 36 to regulate the flow of water. Preferably, four tubes 32 and 36 are used, each having nozzles 30 for atomizing the water into the combustion zone Z in near proximity to the flame area 38. It is preferred that tubes 36 rest in a manifold connected to the water supply through a central valve (not shown). Preferably, tubes 32 and 36 are made of ¼ inch I.D. tubing.

Water is injected in an atomized spray from the nozzles 30 near the flame 38. In U.S. Pat. No. 4,118,195, a similar combustion chamber was described, but without the water injection means, with temperatures of about 2,200° C. being prevalent. At these high temperatures NOx formation occurs easily through the fixation of nitrogen with oxygen used in combustion. As is known, nitrogen fixation can be reduced substantially at lower temperatures. The water injection provided in the method of this invention has been found to lower the temperature ranges in the combustion zone from 1,650°-2,200° C. to 1,100°-1,650° C. without hampering the large output of heat to the oil-producing formation. For example, when 227 liters of petroleum per hour is burned in the combustion chamber C and 0.75 liters of water per minute is injected into the chamber C, the temperature of the combustion gases drops to about 2065° C. If as much as 15 liters of water per minute is injected in an atomized spray the gas temperature will decrease to about 1370° C.

The combustion gases exit the combustion chamber C under pressure and pass through the flange 16 connecting the combustion chamber C to the vapor producing vessel V. The hot, pressurized combustion gases pass through the gas injection means 40 and exit at the opening 42 of the combustion gas injection means so that they impinge upon the water 44 at the bottom of the vapor producing vessel V. The degree of impingement can be varied by adjusting the water level in the vessel V. The water maintained in the bottom of the vessel V serves also to trap any solids which may be in the combustion gases and thereby prevent plugging of downstream equipment.

The combustion gases pass upwardly through the vessel V and are contacted by an atomized water spray from nozzles 46, water jacket 50, nozzles 52, pipe 54, leader 56 and tubes 58 and 60. While two tubes 58 and 60 are shown, it will be understood that one or more such tubes can be used.

Either anhydrous ammonia or aqueous ammonia solutions can be used to reduce the acidic constituents in the thermal vapor by injection into the thermal vapor stream, preferably in the vapor producing vessel V or upon exit therefrom through fitting 62.

When an aqueous solution of ammonia is used it is supplied from a source through a tube 64 to the vapor producing vessel V through water line 54. Spray nozzles 46 are provided to disperse the ammonia solution into the water vapor-combustion gas mixture generated in the vapor producing vessel V. Ammonia acts as a reducing agent in achieving corrosion control by substantially reducing the concentration of oxides of nitrogen and sulfur extant in the water vapor-combustion gas mixture. The ammonia further acts to neutralize any acids such as the sulfur oxides in the gases themselves and, in conjunction with the water injection system previously described, renders the thermal vapor substantially non-corrosive. The aqueous ammonia solution preferably used in this invention contains from about 1.0 weight percent ammonia to about 6.0 weight percent ammonia when it is injected into the thermal vapor stream. Anhydrous ammonia can be used as well and injected directly into the thermal vapor stream leaving the vessel V through fitting 62. Such connections are not shown but would be readily understood by those skilled in the art.

The amount of ammonia utilized as a reducing agent to control the corrosive effects of nitrogen oxides and sulfur oxides in the water vapor-combustion gas thermal vapor stream can be readily determined from the sulfur and nitrogen content of the hydrocarbon fuel burned to produce the combustion gases. Of course, it should be realized that hydrocarbon fuel low in sulfur and nitrogen does not need as much ammonia to reduce the concentration of nitrogen oxides and sulfur oxides. It has been discovered that injecting from about 0.001 to about 0.005 kilograms of ammonia per kilogram of steam in the thermal vapor stream, preferably about 0.004 kilograms ammonia per kilogram of steam renders the thermal vapor stream substantially noncorrosive. The ammonia injection in combination with the water injection in the combustion chamber lowers the concentration of nitrogen oxides in the thermal vapor stream to about 1.0 to about 3.0 ppm and the concentration of sulfur dioxide to below 1.0 ppm.

The use of water injection in the combustion chamber and the addition of ammonia as a reducing agent further lowers the quantities of oxides of nitrogen and sulfur in the combustion gases. The result is a hot, high pressure, thermal vapor stream substantially noncorrosive to various metals used downstream from the equipment producing the thermal vapor stream.

The following examples are used to illustrate the substantial reduction in concentration of nitrogen oxide and sulfur oxides afforded by the practice of this invention. Where previously the thermal vapor stream produced using the fuel of the examples below caused serious corrosion problems, the method herein disclosed and exemplified below, resulted in substantially trouble-free operation. Of course, it should be understood that reactants, proportions of reactants, and time, temperature and pressure of the method may be varied in accordance with the foregoing discussion with much the same results being achieved. Thus, the examples should be construed as illustrative and not limiting.

EXAMPLES I-II

The combustion chamber C and vapor producing vessel V illustrated in FIG. 1 were used to produce a thermal vapor stream in accordance with the prior disclosure. Petroleum, with a concentration of 5 percent sulfur by weight and 2 percent nitrogen by weight, was the hydrocarbon fuel burned at a rate of about 227 liters per hour to produce the combustion gases. Sufficient water (about 15 liters per minute) was atomized into the flame zone Z of the combustion chamber in an amount to prevent the temperature of the combustion chamber from exceding 1,650° C. A 3 percent molar excess of air was mixed with the combustion fuel while pressure was maintained at about 13,700 mm. Hg. in the combustion chamber. An aqueous solution of 3.5 percent by weight ammonia was injected into the vapor producing vessel in an atomized form by spray nozzles 46. The quantity of ammonia employed was 0.004 kilograms of ammonia per kilogram of steam. Samples of the high pressure thermal vapor stream produced by the process were taken after two different runs. Gas chromatographic analysis of each sample revealed the results listed below in Table I. It was discovered that the concentrations of nitrogen oxides were in one case below 1.0 ppm and in the second example at 3.0 ppm. The sulfur dioxide concentrations in both examples analyzed at below 1.0 ppm. This tremendous reduction was an unexpected surprise.

TABLE I

GAS CHROMATOGRAPHIC ANALYSIS

| | Ex. 1 Mol % | Ex. 2 Mol % |
|---|---|---|
| Hydrogen | <0.05 | <0.05 |
| Oxygen | 2.75 | 1.44 |
| Nitrogen | 86.18 | 86.14 |
| Carbon Dioxide | 12.07 | 12.42 |
| Carbon Monoxide | <0.05 | <0.05 |
| Methane | <0.05 | <0.05 |
| Other Hydrocarbons ($C_2$—$C_5$) | <0.05 | <0.05 |
| Total | 100.00 | 100.00 |
| Sulfur Dioxide | <1 ppm/wt % | <1 ppm/wt % |
| Ammonia | <10 ppm/wt % | <10 ppm/wt % |
| Oxides of Nitrogen | <1 ppm/wt % | 3 ppm/wt % |

Continued operation of the thermal vapor production unit following the method of this invention demonstrated that the corrosion problems previously experienced were eliminated. At times when thermal vapors were injected into the formation and vented into the atmosphere, there was no qualitative evidence of the presence of either nitrous or sulfurous oxides. Previously, these oxides had been readily detectable when the steps of this invention were not being practiced.

Many variations of the foregoing invention will be evident to those skilled in the art which are yet within, and are intended to be within, the scope of the invention as claimed.

We claim:

1. In a method of producing a high pressure thermal vapor stream of water vapor and combustion gases, for injection into a subterranean formation to stimulate the production of viscous minerals, comprising burning a substantially stoichiometric ratio of fuel and air in a combustion zone under pressure to produce combustion gases, and contacting the combustion gases with water in a vapor producing vessel, to form a thermal vapor stream for injecting into the formation, the improvement for preventing corrosion of equipment which comprises:

injecting sufficient water into the combustion zone simultaneously with burning the fuel to maintain a temperature within such combustion chamber within the range of from 1100° C. to 1650° C.; and injecting ammonia into the thermal vapor stream exiting the vapor producing vessel whereby such thermal vapor stream is rendered substantially non-corrosive to ferrous metals.

2. The method of claim 1 where the aqueous ammonia solution has a concentration of about 3.5% ammonia by weight.

3. The method of claim 1 where anhydrous ammonia is added to the mixture of steam, water and combustion gases in the vapor producing vessel.

4. The method of claim 1 where the fuel burned to produce the combustion gases contains up to about 5% sulfur by weight and up to about 2% nitrogen by weight.

5. The method of claim 1 where the combustion gases produced impinge upon the surface of water maintained in the vapor producing vessel.

6. In a method of producing a high pressure thermal vapor stream of water vapor and combustion gases, for injection into a subterranean formation to stimulate the production of viscous minerals, comprising, burning a substantially stoichiometric ratio of fuel and air in a combustion zone to produce a combustion gas, and contacting the combustion gases with water in a vapor producing vessel to form a thermal vapor stream for injection into the formation, the improvement which comprises:

injecting from about 0.2 to about 4 liters of water per liter of fuel into a primary combustion zone with the fuel; and injecting from about 0.001 to about 0.005 kilograms of ammonia per kilogram of steam produced in the vapor producing vessel whereby such thermal vapor stream is rendered substantially noncorrosive to ferrous metals.

7. A method of producing a high pressure thermal vapor stream of water vapor and combustion gases, for injection into a subterranean formation to stimulate the production of viscous minerals, comprising, burning in a combustion zone, a substantially stoichiometric ratio of fuel and air in the presence of from about 0.2 to about 4 liters of water per liter of fuel, such water being atomized into the flame zone through a plurality of nozzles, to form combustion gases;

conducting the combustion gases from the combustion zone into a vapor producing vessel causing the combustion gases to impinge upon the surface of water being maintained in the vessel at a level below the opening of a combustion gases injection means; and contacting the combustion gases, in countercurrent flow, with an atomized water spray containing from about 1.0 to about 6.0 weight percent ammonia in an amount such that from about 0.001 to about 0.005 kilograms of ammonia per kilogram of steam produced is injected, thereby producing a substantially non-corrosive thermal vapor is roduced.

* * * * *